US007298236B2

(12) United States Patent
Chen

(10) Patent No.: US 7,298,236 B2
(45) Date of Patent: Nov. 20, 2007

(54) CIRCUIT BREAKER ELECTROMAGNETIC TRIPPING DEVICE

(76) Inventor: Jingzheng Chen, No. 21-23 Gonghang Road, Qian'an, Beibaixiang, Yueqing City, Zhejiang 325603 (CN)

( * ) Notice: Subject to any disclaimer, the term of this patent is extended or adjusted under 35 U.S.C. 154(b) by 260 days.

(21) Appl. No.: 11/223,779

(22) Filed: Sep. 9, 2005

(65) Prior Publication Data

US 2006/0244556 A1 Nov. 2, 2006

(30) Foreign Application Priority Data

Apr. 27, 2005 (CN) ..... 2005 1 0039137
Apr. 27, 2005 (CN) ..... 2005 2 0071226

(51) Int. Cl.
*H01H 9/00* (2006.01)

(52) U.S. Cl. ..... 335/21; 335/26; 335/172; 335/174; 335/175; 335/177

(58) Field of Classification Search ..... 335/6, 335/21–45, 172–178
See application file for complete search history.

(56) References Cited

U.S. PATENT DOCUMENTS 6,150,909 A * 11/2000 Meier ..... 335/132
7,098,761 B2 * 8/2006 Germain et al. ..... 335/18
2004/0201438 A1 * 10/2004 Gao ..... 335/6

FOREIGN PATENT DOCUMENTS

CN 2575839 Y 9/2003

* cited by examiner

*Primary Examiner*—Ramon M. Barrera
(74) *Attorney, Agent, or Firm*—Knobbe Martens Olson & Bear LLP

(57) ABSTRACT

A circuit breaker electromagnetic tripping device in which the contact between the movable contacts and the stationary contacts is stable and well, and the tripping does not tend to fail is disclosed. In one embodiment, the circuit breaker device comprises a casing, a tripping armature and a tripping armature spring which are disposed transversely within the casing, and a tripping coil fitted over the casing corresponding to tripping armature. The device also includes a moveable support which is disposed longitudinally within the casing and moveable inside the casing and a lower end of the moveable support can be engaged with or disengaged from a front end of the tripping armature, and an attracting armature and an attracting armature spring which are disposed longitudinally at a center of the moveable support. The circuit breaker device further includes an attracting coil which is fitted over the casing at a position corresponding the attracting armature and a longitudinal central axis of the attracting coil is consistent with that of the moveable support and a plurality of moveable contact assemblies which are disposed at two sides of the moveable support.

12 Claims, 8 Drawing Sheets

CIRCUIT BREAKER ELECTROMAGNETIC TRIPPING DEVICE

BACKGROUND OF THE INVENTION

1. Field of the Invention

The present invention relates to a circuit breaker tripping device. More particularly, the present invention relates to an electromagnetic tripping device for a circuit breaker.

2. Description of Related Technology

A tripping device is a main component part of a circuit breaker and used as an actuator of the circuit breaker which interrupts a circuit by separating a moveable contact piece from a stationary contact piece when the circuit is in abnormal conditions. The circuit breaker used to provide circuit interruption to the circuit and to protect the circuit from ground faults generally employs an electromagnetic tripping device.

The Chinese Utility Model CN2575839Y disclosed a circuit breaker entitled "ground fault circuit breaker having a protection from reverse wiring connection." The noted circuit breaker employs an electromagnetic tripping device comprising an electromagnetic member for generating electromagnetic force: It also includes an armature mounted slidably within the electromagnetic member and movable under the electromagnetic force and a frame body connected to the armature and moved between a first position and a second position along an axis of the electromagnetic member by driving of the armature. The frame body causes a moveable contact piece to contact with or separate from a stationary contact piece. The circuit breaker also includes a locking member for fixing the armature in the second position. The frame body has a protrusion thereon, in which in the first position, the protrusion engages the movable contact, and in the second position, the frame body pushes the moveable contact piece to contact with the stationary contact piece through the protrusion. The locking member is a permanent magnet which can attract one end of the armature through a magnetic force and contact therewith. The magnetic force of the permanent magnet is used as a retaining force when the ground fault circuit breaker is in a switching on state.

The above conventional electromagnetic tripping device has the following defects. The frame body pushes the moveable contact piece to contact with the stationary contact piece through the protrusion, and an arm of the moveable contact piece needs to have a certain length, thus causing contact between the moveable contact piece and the stationary contact piece unstable and poor. The permanent magnet is used as the locking member for fixing the armature in the second position and the magnetic force of the permanent magnet is used as the retaining force when the ground fault circuit breaker is in a switching on state. The magnet is required to have sufficient magnetic force so as to attract and contact the armature, accordingly, when there is a fault current, the electromagnetic member is also required to have sufficient electromagnetic force so as to move the armature. Thus, when the armature is separated from the permanent magnet and returned to the first position, the moveable contact piece is separated from the stationary contact piece under the elastic force of the moveable contact piece, it tends to cause a tripping failure of the circuit breaker.

SUMMARY OF CERTAIN INVENTIVE ASPECTS

One aspect of the present invention provides a circuit breaker electromagnetic tripping device in which the contact between the movable contacts and the stationary contacts is stable and the tripping action is prompt when fault current occurs. Another aspect of the present invention provides a circuit breaker electromagnetic tripping device in which the contact between the movable contacts and the stationary contacts is stable and the tripping action is prompt when fault current, short circuit current and overload current occur. The circuit breaker electromagnetic tripping device according to the present invention is particularly adapted to ground fault circuit breaker.

Another aspect of the present invention provides a circuit breaker electromagnetic tripping device, comprising a casing; a tripping armature and a tripping armature spring which are disposed transversely within the casing; a tripping coil fitted over the casing at a position corresponding to the tripping armature; a moveable support which is disposed longitudinally within the casing and moveable inside the casing and a lower end of the moveable support can be engaged with or disengaged from a front end of the tripping armature; an attracting armature and an attracting armature spring which are disposed longitudinally at a center of the moveable support; an attracting coil which is fitted over the casing at a position corresponding the attracting armature and a longitudinal central axis of the attracting coil is consistent with that of the moveable support; and moveable contact assemblies which are disposed at two sides of the moveable support.

In one embodiment, with the circuit breaker electromagnetic tripping device, when current leakage occurs in the circuit, a tripping current signal is sent to the tripping coil, so that the tripping armature acts promptly so as to be disengaged from the moveable support. Since there is not a retaining force, the moveable support will be moved downwards so as to cause the moveable contacts to be separated from the stationary contacts. When an attracting current signal is sent to the attracting coil, the attracting armature will drive the moveable support to move upwards so as to cause the move contacts to contact with the stationary contacts, at the same time, the tripping armature is engaged with the moveable support so as to maintain contact between the move contacts and the stationary contacts.

Another aspect of the present invention provides a circuit breaker electromagnetic tripping device, comprising a casing; a tripping armature and a tripping armature spring which are disposed transversely within the casing; a tripping coil fitted over the casing at a position corresponding to tripping armature; a moveable support which is disposed longitudinally within the casing and moveable inside the casing and a lower end of the moveable support can be engaged with or disengaged from a front end of the tripping armature; an attracting armature and an attracting armature spring which are disposed longitudinally at a center of the moveable support; an attracting coil which is fitted over the casing at a position corresponding the attracting armature and a longitudinal central axis of the attracting coil is consistent with that of the moveable support; moveable contact assemblies which are disposed at two sides of the moveable support; and a short circuit tripping coil fitted over the tripping armature.

In one embodiment, with the circuit breaker electromagnetic tripping device, when current leakage occurs in the circuit, the tripping armature acts promptly so as to cause the moveable contacts to be separated from the stationary contact, in addition, when short circuit fault occurs in the circuit, a tripping current signal is sent to the short circuit tripping coil, so that the tripping armature also acts promptly so as to be disengaged from the moveable support, since there is not a retaining force, the moveable support will move downwards so as to cause the moveable contacts to be separated from the stationary contacts. Since a dual metallic piece is provided to the tripping armature, when over loading fault occurs in the circuit, the over current will pass through the dual metallic piece, so that the dual metallic piece deforms thermally so as to pull the tripping armature, similarly, the tripping armature is disengaged from the moveable support, since there is not a retaining force, the moveable support will move downwards so as to cause the moveable contacts to be separated from the stationary contacts.

In one embodiment, the circuit breaker electromagnetic tripping device is configured such that the lower end of the moveable support can be engaged with or disengaged from the front end of the tripping armature and the moveable contact assemblies are provided at two side of the moveable support, so that the tripping action is prompt and contact between the moveable contacts and the stationary contacts is stable.

BRIEF DESCRIPTIONS OF THE DRAWINGS

Embodiments of the invention will become apparent from the following detailed description with reference to the drawings.

DETAILED DESCRIPTION OF CERTAIN INVENTIVE EMBODIMENTS

Embodiments of the present invention are described in detail with reference to the drawings.

First Embodiment

Figure 1:
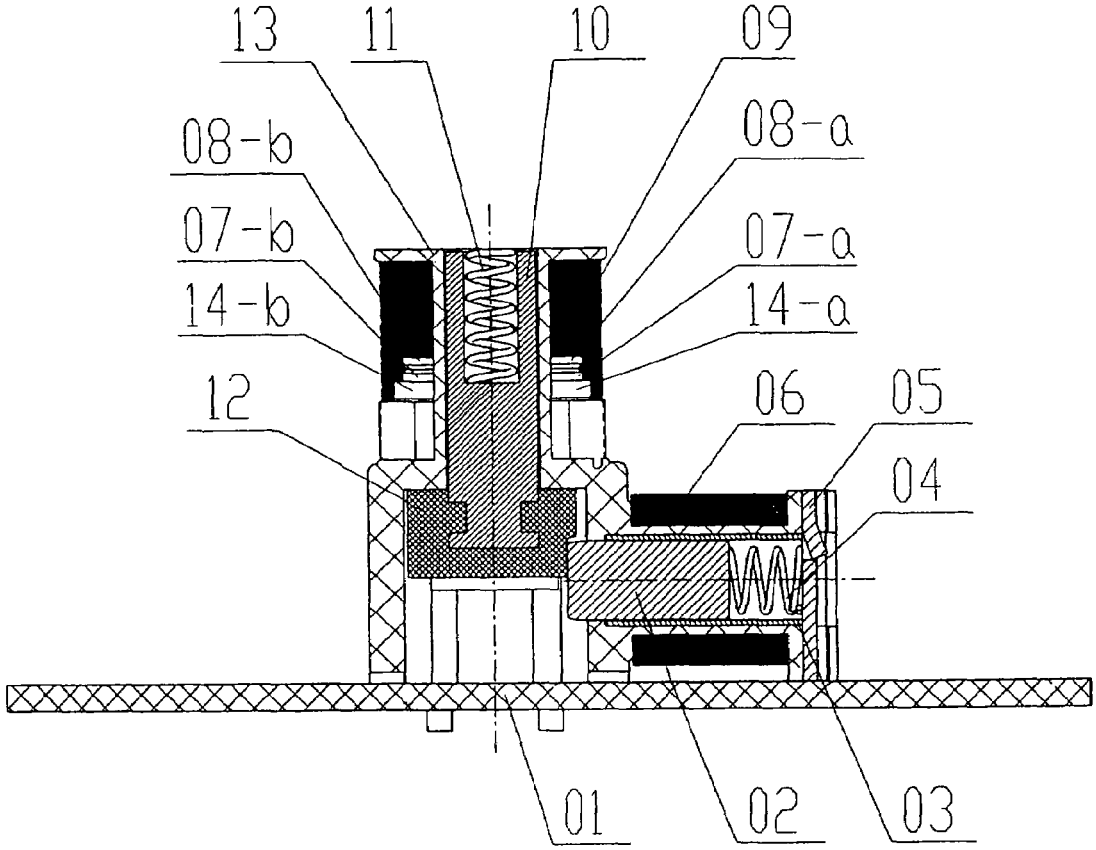
FIG. 1 is a sectional structural view of a tripping device in an attracted state according to a first embodiment of the present invention.
Figure 2:
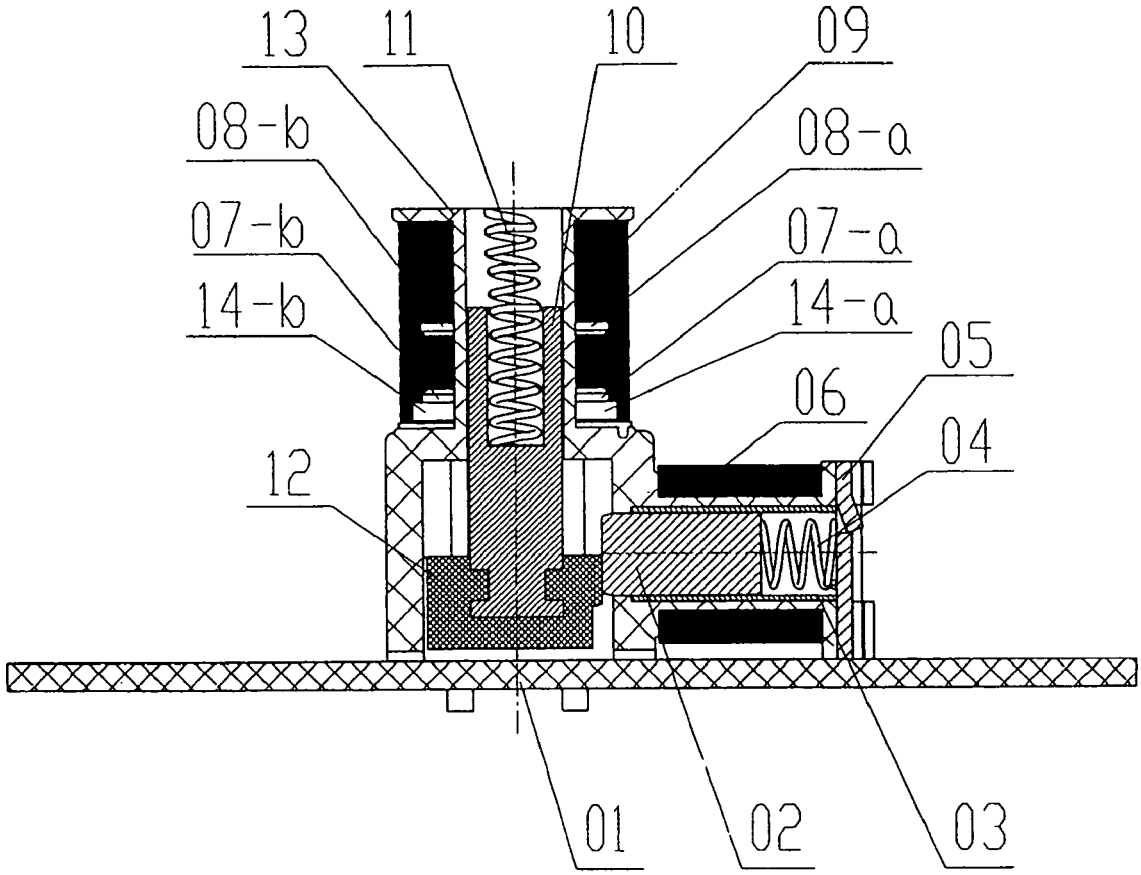
FIG. 2 is a sectional structural view of the tripping device in a tripped state according to the first embodiment of the present invention.
Figure 3:
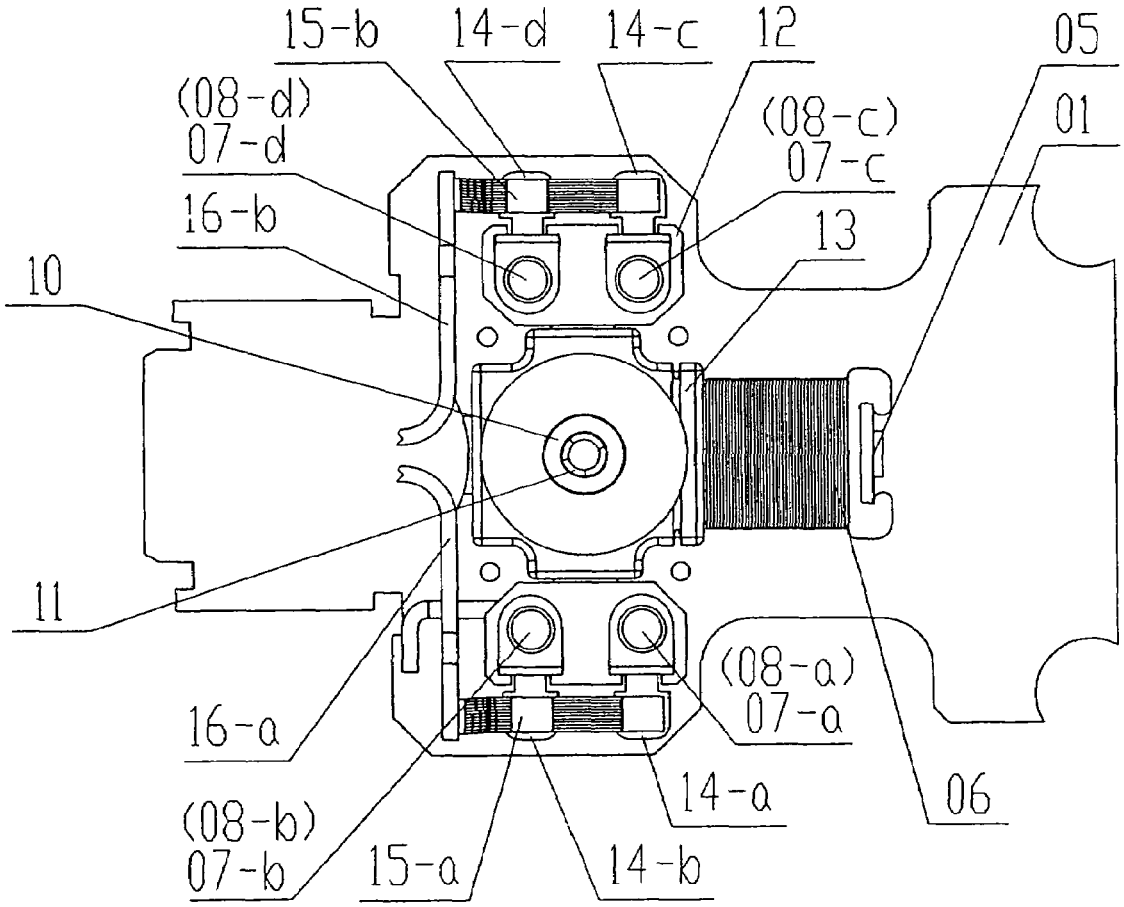
FIG. 3 is a top view showing an appearance of the tripping device according to the first embodiment of the present invention.

As shown in FIG. 1 to FIG. 3, a circuit breaker electromagnetic tripping device according to the first embodiment is illustrated, the circuit breaker electromagnetic tripping device comprises a casing 13, a tripping armature 02 and a tripping armature spring 04 which are disposed transversely within the casing 13, and a tripping coil 06. In order to reduce friction between the tripping armature 02 and the casing 13, a metallic lubrication sleeve 03 made of nonmagnetic material is provided. The tripping coil 06 is fitted over and uses a portion of the casing 13 corresponding to the tripping armature 02 as its coil skeleton. A moveable support 12 is disposed longitudinally within the casing 13 and can move longitudinally within the casing 13, and an attracting armature 10 and an attracting armature spring 11 are provided longitudinally at the center of the moveable support 12. An attracting coil 09 is fitted over the casing 13 at a position corresponding the attracting armature 10, so that the longitudinal central axis of the attracting coil 09 is consistent with that of the moveable support 12, and the attracting coil 9 is fitted over and uses a portion of the casing 13 as its coil skeleton in the same manner as that of the tripping coil 06.

As shown in FIG. 1, a lower end of the moveable support 12 is engaged with a front end of the tripping armature 02 and the moveable support 12 is at an upper position, so that moveable contacts 07-*a* and 07-*b* are contacted with stationary contacts 08-*a* and 08-*b* respectively. As shown in FIG. 2, the lower end of the moveable support 12 is disengaged from the front end of the tripping armature 02 and the moveable support 12 is at a lower position, so that moveable contacts 07(*a, b*) are separated from the stationary contacts 08(*a, b*) respectively. In drawings, the numeral 1 denotes a mounting plate for applying the electromagnetic tripping device of the present invention to a circuit breaker; 5 denotes a spring blocking plate; 14 denotes moveable contact seat; 15 denotes soft connecting wire; 16 denotes magnetic ring connecting wire.

Figure 4:
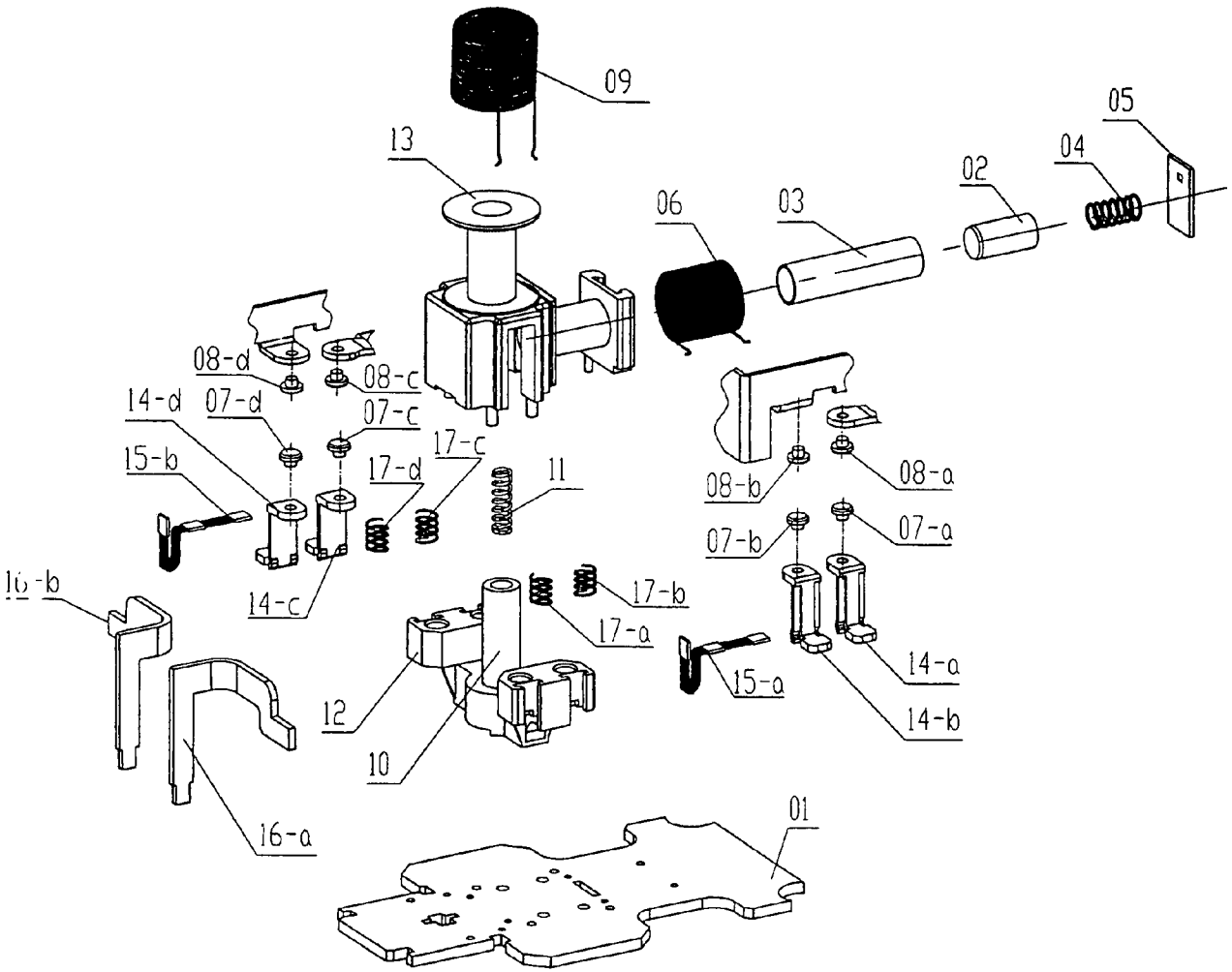
FIG. 4 is an exploded perspective view of the tripping device according to the first embodiment of the present invention.

As shown in FIG. 4, the circuit breaker electromagnetic tripping device according to the first embodiment is illustrated, in which the moveable contact assemblies comprise moveable contacts 07 (*a, b, c, d*), moveable contact springs 17 (*a, b, c, d*) and moveable contact seats 14 (*a, b, c, d*). There are two pairs of moveable contacts, one pair of which are provided at one side of the moveable support 12 and the other pair are provided at the other side thereof.

With the electromagnetic tripping device of the present embodiment being applied to a circuit breaker, when the moveable and the stationary contacts of the circuit breaker are contacted with each other so as to switch on the circuit, the front end of the tripping armature is engaged with the lower end of the moveable support so that the moveable support is held at the upper position, and the moveable and the stationary contacts are in the attracted state. When electric leakage fault occurs in the circuit, a detecting circuit of the circuit breaker sends a tripping signal immediately, the tripping coil is powered so that the tripping armature is pulled to move rearwards against the elastic force of the tripping armature spring, the tripping armature is consequently disengaged from the moveable support. The moveable support moves downward to the lower position under the elastic force of the attracting armature spring so that the moveable contacts are caused to be separated from the stationary contacts so as to switch off the circuit, thus achieving the tripping protection from electric leakage.

When the electric leakage fault is eliminated, as long as the detecting circuit of the circuit breaker sends an attracting signal, the attracting coil will be powered so that the attracting armature and the moveable support are caused to move upwards against the elastic force of the attracting armature spring, at the same time, the tripping armature moves forwards under the elastic force of the tripping armature spring so as to be engaged with the moveable support, so that the moveable support is held at the upper position and the moveable and the stationary contacts are in the attracted state.

Second Embodiment

Figure 5:
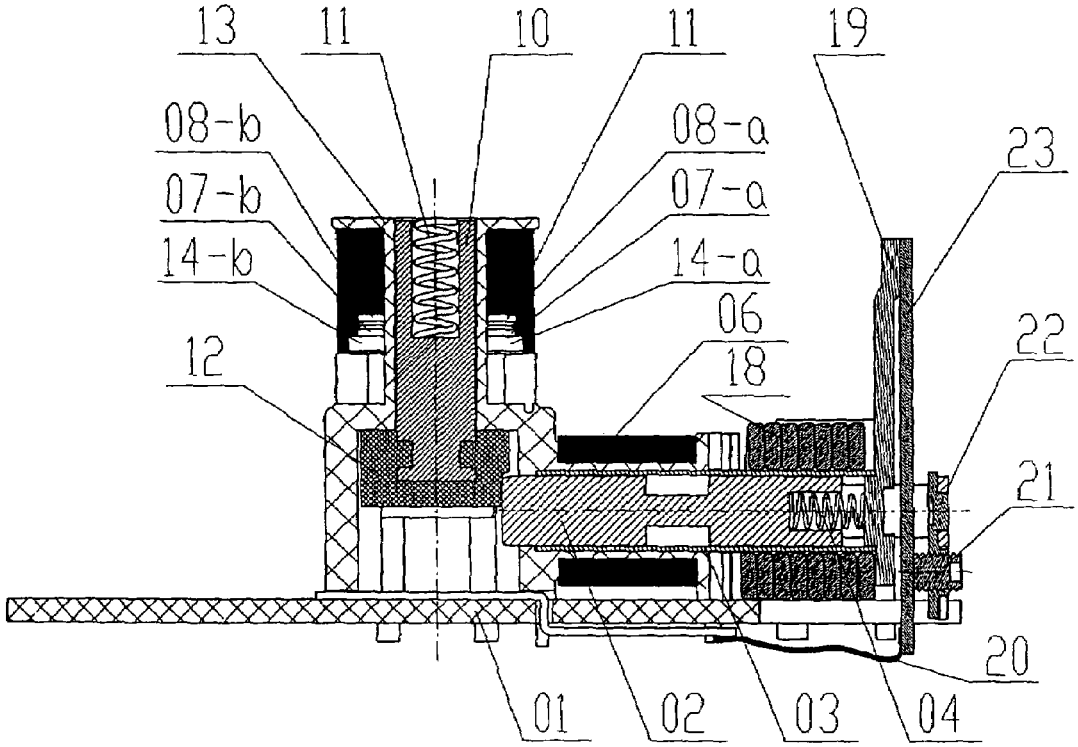
FIG. 5 is a sectional structural view of a tripping device in an attracted state according to a second embodiment of the present invention.
Figure 6:
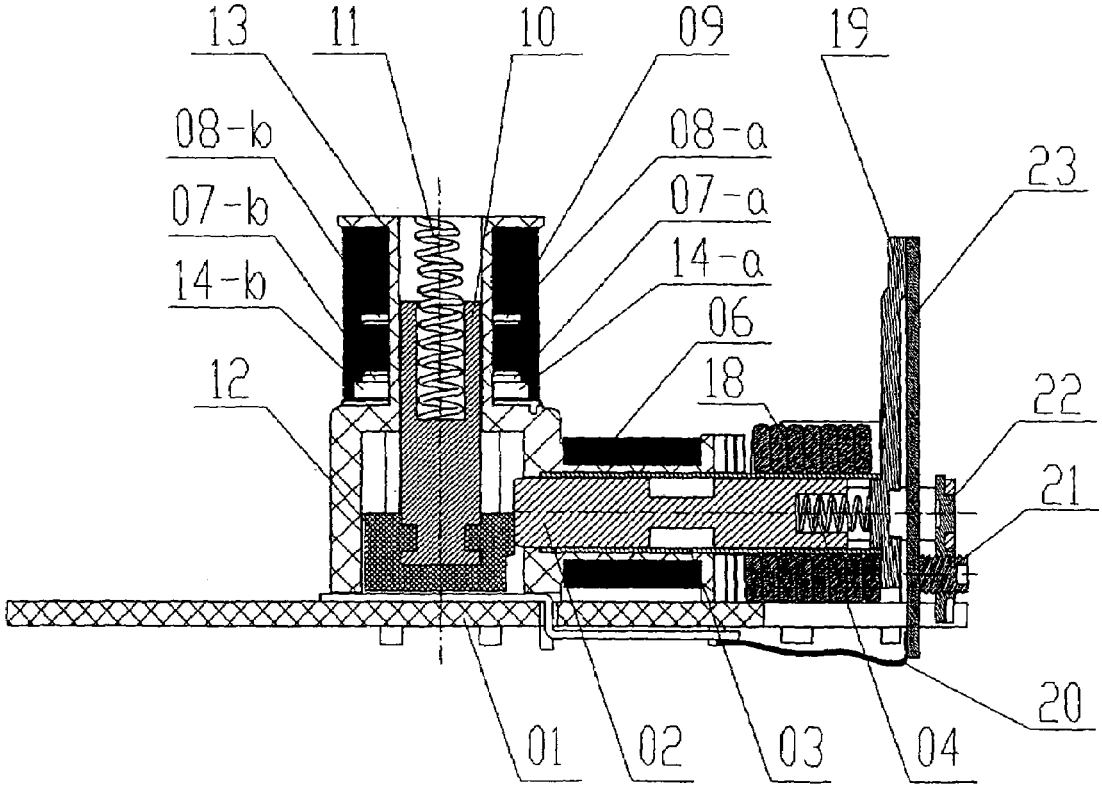
FIG. 6 is a sectional structural view of the tripping device in a tripped state according to the second embodiment of the present invention.
Figure 7:
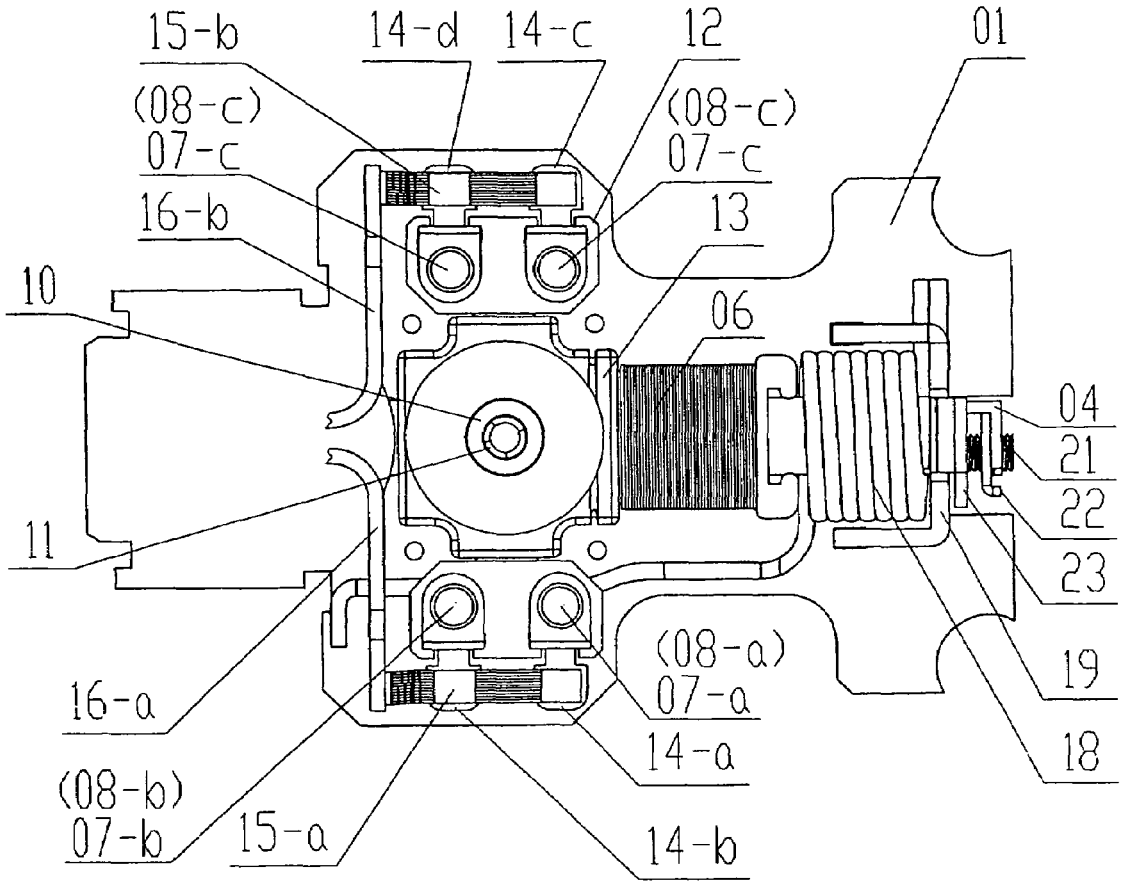
FIG. 7 is a top view showing an appearance of the tripping device according to the second embodiment of the present invention.

As shown in FIG. 5 to FIG. 7, a circuit breaker electromagnetic tripping device according to the second embodiment is illustrated. The circuit breaker electromagnetic tripping device according to the second embodiment is constructed such that a short circuit tripping coil 18 and a dual metallic piece 23 are added to the tripping armature 02 of the first embodiment and a magnetic yoke 19 is provided between the short circuit tripping coil 18 and the dual metallic piece 23 based on the circuit breaker electromagnetic tripping device shown in FIG. 1 to FIG. 3. Here, one end of the dual metallic piece 23 is connected to one end of the magnetic yoke 19. In drawings, the numeral 20 denotes soft connecting wire, 21 denotes adjustment screw, and 22 denotes screw seat.

Figure 8:
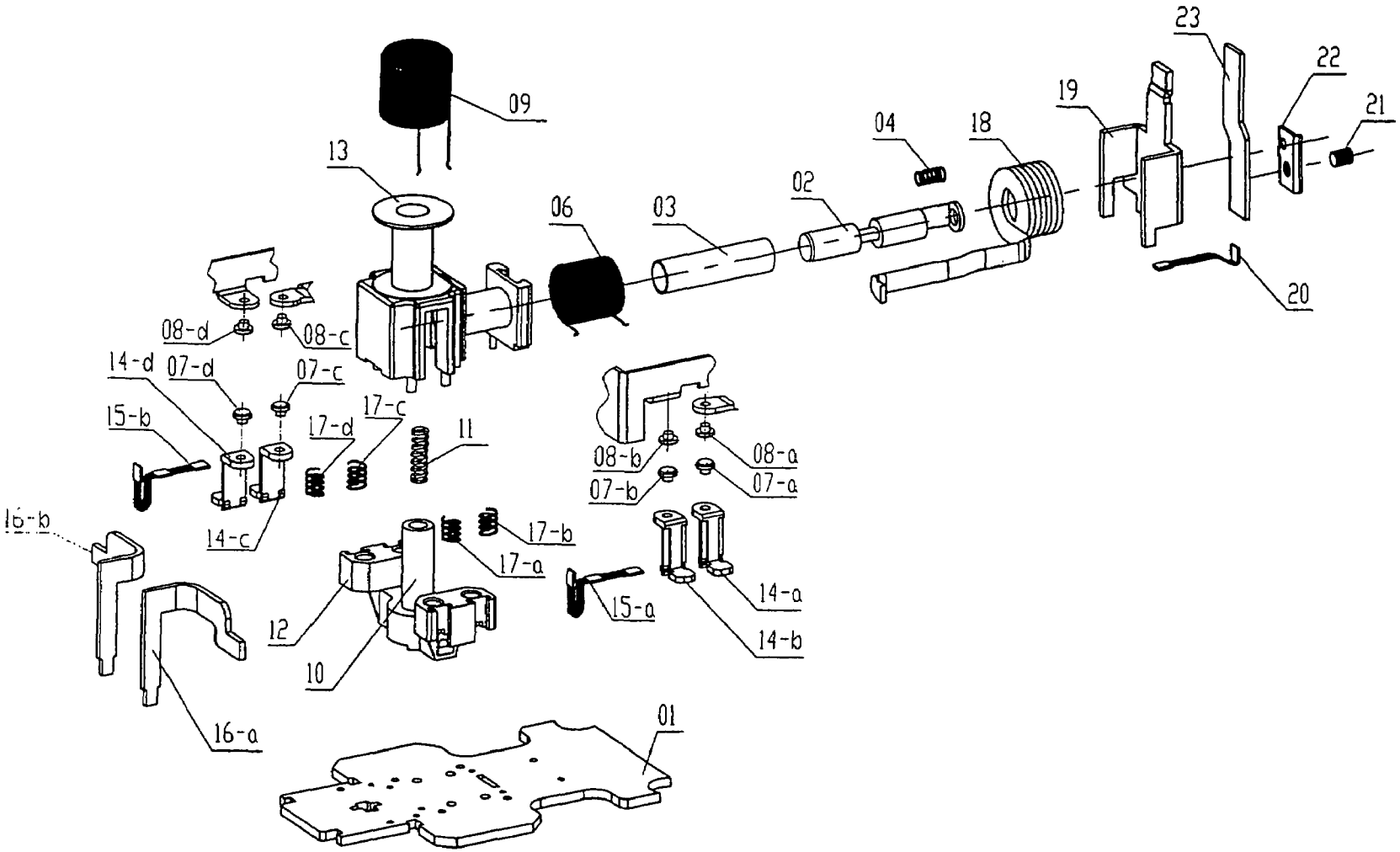
FIG. 8 is an exploded perspective view of the tripping device according to the second embodiment of the present invention.

FIG. 8, corresponding to FIG. 4, is an exploded perspective view of the tripping device according to the second embodiment of the present invention, illustrates, in the circuit breaker electromagnetic tripping device of the second embodiment, the short circuit tripping coil 18 and a dual metallic piece 23 are added to the tripping armature 02 of the first embodiment and the magnetic yoke 19 is provided between the short circuit tripping coil 18 and the dual metallic piece 23.

With the circuit breaker electromagnetic tripping device according to the second embodiment being applied to the circuit breaker, in addition to the tripping protection from electric leakage, the electromagnetic tripping device can also achieve the tripping protection from short circuit and overload. That is, when short circuit fault occurs in the circuit, the detecting circuit of the circuit breaker sends a tripping signal immediately, so that the short circuit tripping coil is powered so as to cause the tripping armature to move rearwards against the elastic force of the tripping armature spring, the tripping armature is consequently disengaged from the moveable support, further, the movable support is moved downwards to the lower position under the elastic force of the attracting armature spring so that the moveable contacts are separated from the stationary contacts so as to shut off the circuit, thus achieving the tripping protection from the short circuit. When overload fault occurs in the circuit, an overload current generates and passes through the dual metallic piece so as to cause the dual metallic piece to deform thermally, thus applying an outward pulling force to the tripping armature, so that the tripping armature moves rearwards against the elastic force of the tripping armature spring, then the tripping armature is disengaged from the moveable support, and the moveable support is moved to the lower position under the elastic force of the attracting armature spring. Consequently, the moveable contacts are separated from the stationary contacts so as to shut off the circuit, thus achieving the tripping protection from the electric leakage.

Although the preferred embodiments of the present invention have been described for illustrative purpose, those skilled in the art will appreciate that various modifications, additions and substitutions are possible, without departing from the scope and spirit of the invention the scope of which is defined in the claims and their equivalents.

What is claimed is:

1. A circuit breaker electromagnetic tripping device, comprising:

a casing;

a tripping armature and a tripping armature spring which are disposed transversely within the casing;

a tripping coil fitted over the casing at a position corresponding to the tripping armature;

a moveable support which is disposed longitudinally within the casing and moveable inside the casing and a lower end of the moveable support can be engaged with or disengaged from a front end of the tripping armature;

an attracting armature and an attracting armature spring which are disposed longitudinally at a center of the moveable support;

an attracting coil fitted over the casing at a position corresponding to the attracting armature and a longitudinal central axis of the attracting coil is consistent with that of the moveable support; and a plurality of moveable contact assemblies which are disposed at two sides of the moveable support.

2. The circuit breaker electromagnetic tripping device according to claim 1, wherein a step is provided at one side of the lower end of the moveable support so that the front end of the tripping armature can be engaged with or disengaged from the step.

3. The circuit breaker electromagnetic tripping device according to claim 1, wherein a lubrication sleeve made of nonmagnetic material is provided between the tripping armature and the casing.

4. A circuit breaker electromagnetic tripping device, comprising:

a casing;

a tripping armature and a tripping armature spring which are disposed transversely within the casing;

a tripping coil fitted over the casing at a position corresponding to the tripping armature;

a moveable support which is disposed longitudinally within the casing and moveable inside the casing and a lower end of the moveable support can be engaged with or disengaged from a front end of the tripping armature;

an attracting armature and an attracting armature spring which are disposed longitudinally at a center of the moveable support;

an attracting coil fitted over the casing at a position corresponding to the attracting armature and a longitudinal central axis of the attracting coil that is consistent with that of the moveable support;

a plurality of moveable contact assemblies which are disposed at two sides of the moveable support respectively; and a short circuit tripping coil fitted over the tripping armature.

5. The circuit breaker electromagnetic tripping device according to claim 4, wherein a dual metallic piece is provided on the tripping armature.

6. The circuit breaker electromagnetic tripping device according to claim 4, wherein a step is provided at one side of the lower end of the moveable support so that the front end of the tripping armature can be engaged with or disengaged from the step.

7. The circuit breaker electromagnetic tripping device according to claim 4, wherein a lubrication sleeve made of nonmagnetic material is provided between the tripping armature and the casing.

8. The circuit breaker electromagnetic tripping device according to claim 6, wherein a lubrication sleeve made of nonmagnetic material is provided between the tripping armature and the casing.

9. The circuit breaker electromagnetic tripping device according to claim 4, wherein a magnetic yoke is provided between said short circuit coil of the tripping armature and a dual metallic piece.

10. The circuit breaker electromagnetic tripping device according to claim 6, wherein a magnetic yoke is provided between said short circuit coil of the tripping armature and a dual metallic piece.

11. The circuit breaker electromagnetic tripping device according to claim 7, wherein a magnetic yoke is provided between the short circuit coil on the tripping armature and the dual metallic piece.

12. The circuit breaker electromagnetic tripping device according to claim 4, wherein a magnetic yoke is provided between the short circuit coil on the tripping armature and the dual metallic piece, and one end of a dual metallic piece is connected to the magnetic yoke.

* * * * *